United States Patent [19]

Musy

[11] Patent Number: 4,459,032

[45] Date of Patent: Jul. 10, 1984

[54] THIN WRIST-WATCH

[75] Inventor: Jean-Pierre Musy, Bienne, Switzerland

[73] Assignee: Societe Suisse pour l'Industrie Horlogere Management Services S.A., Bienne, Switzerland

[21] Appl. No.: 227,448

[22] Filed: Jan. 22, 1981

[30] Foreign Application Priority Data

Jan. 29, 1980 [FR] France ..... 80 02301

[51] Int. Cl.[3] ..... G04B 19/20; G04B 37/00

[52] U.S. Cl. ..... 368/77; 368/234; 368/296

[58] Field of Search ..... 368/77, 79, 220, 221, 368/223, 228, 233, 234

[56] References Cited

U.S. PATENT DOCUMENTS

| | | | |
|---|---|---|---|
| Re. 22,640 | 5/1945 | Prins | 368/77 |
| 2,153,004 | 4/1939 | Robanet | 368/221 |
| 2,618,118 | 11/1952 | Harris et al. | 368/222 |
| 2,852,908 | 9/1958 | Stern et al. | 368/234 |
| 3,408,810 | 7/1968 | Meitinger | 368/220 |
| 3,792,578 | 2/1974 | Hetzel | 368/220 |
| 4,132,061 | 7/1979 | Mathis | 368/220 |
| 4,382,690 | 5/1983 | Erard | 368/77 |

FOREIGN PATENT DOCUMENTS

| | | | |
|---|---|---|---|
| 2204907 | 8/1973 | Fed. Rep. of Germany | 368/77 |
| 428929 | 1/1948 | Italy | 368/77 |
| 48-67767 | 8/1973 | Japan | 368/77 |
| 151 | 1/1889 | Switzerland . | |

*Primary Examiner*—Vit W. Miska

*Attorney, Agent, or Firm*—Griffin, Branigan & Butler

[57] ABSTRACT

A thin electronic wrist-watch the thickness of which is constituted by the superposition of a first crystal, at least two time indicating discs and a case back, the latter including a second crystal. The gears are supported on specially designed studs and means are provided to limit axial gear play.

7 Claims, 2 Drawing Figures

THIN WRIST-WATCH

BACKGROUND OF THE INVENTION

The invention described in U.S. application No. 143,061 filed Apr. 23, 1980 refers to a wrist-watch of small thickness comprising a case, a crystal and at least two time indicating discs. It is remarkable for the fact that its overall thickness is constituted by the superposing of the case back, two time indicating discs and the crystal and also by the fact that the elements forming the watch extend beyond the diameter of the indicating discs, the thickness of the case containing these elements not exceeding the said overall thickness.

The present application has as its object certain refinements to the thin wrist-watch defined above, beyond those which have already been claimed in another patent application relating thereto (U.S. Ser. No. 181,928 filed Aug. 27, 1980) now U.S. Pat. No. 4,367,050. These refinements have as purpose the improvement of the appearance of the watch in question as well as certain expedients employed to facilitate its manufacture.

These purposes are obtained by the means claimed.

DETAILED DESCRIPTION OF THE DRAWINGS

Figure 1:
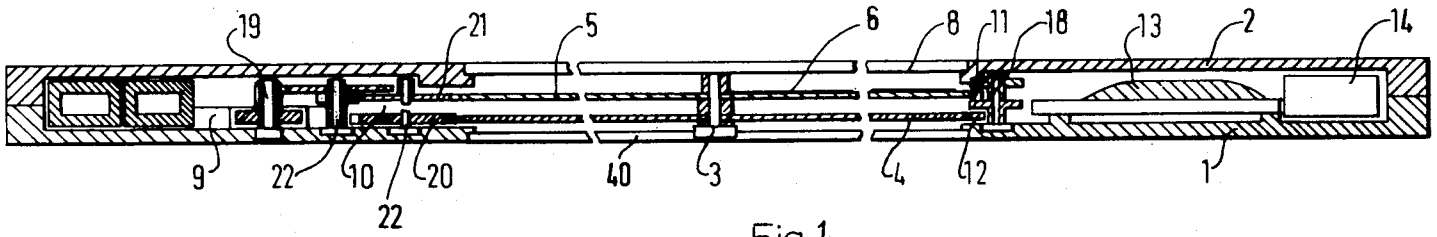
FIG. 1 is a cross section of the watch to an enlarged scale.
Figure 2:
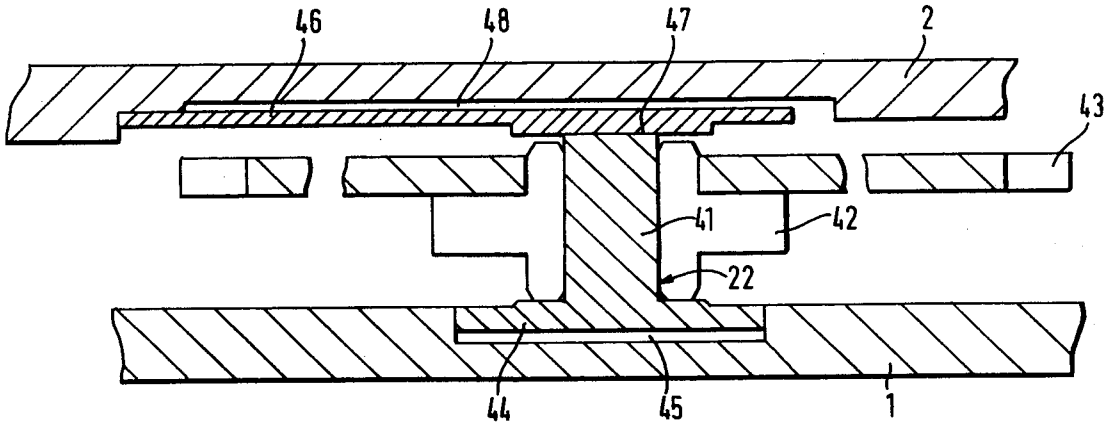
FIG. 2 is a cross section to a still more enlarged scale through one of the gear trains serving to drive the discs.

FIG. 1 is a cross section through the mechanism of the watch in which are employed the same reference numbers which are to be found in FIG. 2 of U.S. application No. 143,061. Thus the case of the watch comprises a case back 1 and a cover 2. The case back forms at the same time the base plate of the watch which supports all the parts either in housings or on studs. In a manner different from U.S. application No. 143,061 and according to the invention the case back of case 1 includes a second crystal 40 set opposite the first 8 which has as purpose to cause the watch to be entirely transparent and confer thereon a new and unexpected aesthetic effect in the sense that the watch appears to be driven without any mechanism.

In one version of the invention the first and the second crystals are obtained through the use of mineral glass and the discs 4 and 5 by means of transparent plastics material for example mylar. In this version in order to avoid that discs in plastics material be statically charged and consequently attract undesirable dust or become deformed, the internal surface of the crystals is coated with an antistatic product which may be a semi-transparent layer of metal, or better still, a transparent metallic oxide of the type ITO (Indium Tin Oxide).

In a preferred version of the invention and above all with the purpose of improving the transparency of the watch, crystals and discs are obtained from sapphire ($Al_2O_3$ Monocrystalline). It will be also noted that the discs obtained from this material enable realization of a perfect flatness of the timepiece this not being so with the discs realized in plastics material which may become deformed and thus create problems in the mechanical operation of the watch. In addition to its rigidity, sapphire in only scratched with difficulty this limiting the problems presented when machining and handling such parts. In this version which comprises at least eight highly reflecting surfaces, the transparency will be still further enhanced by coating said surfaces with an anti-reflection coating as is already known from the state of the art.

These are instances where an absolute transparency is not desirable but where the unexpected aesthetic aspect might wish to be more or less maintained: for example for a wrist-watch it will be desirable to hide the hair on the wrist of the wearer. Thus according to a variant of the invention the interior surface of the second crystal will bear a transparent tinted layer which may for instance be blued or smoked.

As has already been described in U.S. application No. 143,061 the indicating discs are provided with peripheral teeth. The teeth are cut directly in the material forming the discs. In a variant and in order to facilitate the machining of a sapphire disc there may be applied to the exterior of the disc a peripheral metallic crown cut in a form of a washer. The metal may be brass for example. The outer primeter of this crown will subsequently be formed much more easily.

As has also appeared in U.S. application No. 143,061 two diametrically opposed wings extend on either hand of the indicating discs. The left wing includes an electric motor 9 and a gear train 10, the gears pivoting on studs 22. In a construction already known from the state of the art these studs may be integral with the base plate and are obtained directly from the material from which it is made, by milling for instance. This manner of machining (above all when it concerns soft material as gold) does not enable the obtaining of a precision axis on which a gear may easily pivot. In order to overcome this disadvantage it has been proposed to force fit a sleeve over such stud which may enable the latter to be precise and thus adapted to provide a pivot for the gear. Such a construction however leads to an axis of large diameter, such being undesirable in a watch having very small dimensions. Additionally, in the construction mentioned, the gear play is limited by a stopper, force fitted on the interior of the sleeve, this stopper being provided with a flange, the diameter of which exceeds the outer diameter of the sleeve. This arrangement has the disadvantage of preventing disassembly of the gears without damping the gear stopper which must then be replaced.

FIG. 2 proposes according to the invention a preferred construction to overcome the above mentioned disadvantage. There is shown a cross section to a greatly enlarged scale through one of the gears serving to drive the discs. In a base plate (case back) 1 is force fitted or glued the stud 22. Said stud comprises a stem 41 which may be made with sufficient precision to receive directly pinion 42 on which is force fitted wheel 43. It also exhibits a sufficiently small diameter to be adapted to the timepiece described herein. Finally it comprises a base 44 which is force fitted or glued into a blind hole 45 provided in the base plate (case back).

FIG. 2 shows also in accordance with the invention what is done in order to limit the play of the gearing 42, 43. Under cover 2 there is welded, glued or fastened in any suitable manner an elastic blade 46. This blade which may flex in the sense of the plan of the figure is supported on a free end 47 of the stud. Thus it limits the play of the gearing 42, 43. This arrangement facilitates the disassembly of the watch elements when the cover 2 is removed since at this moment the gears may be taken out without having to resort to any force for removing a part. In the preferred example the blade may flex about 0.5 mm towards the base plate and about 0.05 mm towards the cover, this latter in view of the recess 48 provided in said cover. It will be understood that this construction in addition to the advantages which it provides for after-sales service, as explained above, enables the enlarging of the permitted tolerances of thickness and of off-flatness of the cover and of the base plate, this range of tolerances being compensated by the possible movement of the elastic blade 46.

Finally it will be understood that all the gears of the watch are equipped with the same system of limitation of play as shown in FIG. 2 which latter is only an illustration of the invention to increased scale for a single gearing.

What we claim is:

1. A wrist-watch of reduced thickness comprising a case, a crystal and at least two time indicating discs coupled together through a gear train driven by an electric motor controlled by an electronic circuit wherein the overall thickness is constituted by superposition of the case back, the time indicating discs and the crystal, there being only sufficient play arranged on all sides of said discs to permit free movement thereof, the remaining principal watch elements such as the motor, gear train and electronic circuit being located in portions of the case extending beyond the diameter of the indicating discs, said portions having a thickness no greater than the overall thickness and wherein the case back includes a second crystal, the time indicating discs each being transparent but with time indicating indicia thereon and the first-mentioned crystal having engraved or transferred dial markers on its inner surface so as to render the time indicating portion of the watch transparent throughout.

2. A wrist-watch as set forth in claim 1 wherein the time indicating discs are formed from sapphire and include peripheral teeth cut in the sapphire.

3. A wrist-watch as set forth in claim 1 wherein the time indicating discs are formed from sapphire and include a corresponding peripheral metallic crown in which peripheral teeth are cut.

4. A wrist-watch as set forth in claim 1 wherein the time indicating discs and both crystals are coated with an anti-reflection layer.

5. A wrist-watch as set forth in claim 1 wherein the interior surface of the second crystal bears a transparent tinted layer.

6. A wrist-watch of reduced thickness comprising a case, a crystal and at least two time indicating discs coupled together through a gear train driven by an electric motor controlled by an electronic circuit wherein the overall thickness is constituted by superposition of the case back, the time indicating discs and the crystal, there being only sufficient play arranged on all sides of said discs to permit free movement thereof, the remaining principal watch elements such as the motor, gear train and electronic circuit being located in portions of the case extending beyond the diameter of the indicating discs, said portions having a thickness no greater than the overall thickness and wherein the case back includes a second crystal, the time indicating discs each being transparent but with time indicating indicia thereon and the first-mentioned crystal having engraved or transferred dial markers on its inner surface so as to render the time indicating portion of the watch transparent throughout; wherein the case back is equipped with studs arranged and adapted to provide bearing support for pivoting of the discs and members of the gear train and beds arranged and adapted to receive various remaining watch elements, each of said studs being provided with a fixed stem precision machined to receive and to allow the pivoting of said discs and gears directly on said stem and a base member integral with the stem, said base member being glued or force fitted into a blind hole provided on the interior of the case back.

7. A wrist-watch as set forth in claim 6 wherein the axial play of the gears is limited by an elastic blade urged against the free extremity of at least one of said fixed stems, said elastic blade being fixed to the top interior wall of the case.

* * * * *